US011147397B1

(12) United States Patent
Tewksbury et al.

(10) Patent No.: US 11,147,397 B1
(45) Date of Patent: Oct. 19, 2021

(54) WEDGE APPARATUS FOR RETAIL DEVICE DISPLAY

(71) Applicant: Google LLC, Mountain View, CA (US)

(72) Inventors: Christopher Graham Tewksbury, Fairfax, CA (US); Kelvin Lee, Daly City, CA (US); Sherry L. Satola, Mountain View, CA (US); Robin C. Lam, Los Angeles, CA (US); Darren Nicholas Kool, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/173,910

(22) Filed: Feb. 11, 2021

(51) Int. Cl.
*A47F 5/16* (2006.01)

(52) U.S. Cl.
CPC ..... *A47F 5/16* (2013.01); *A47F 2005/165* (2013.01)

(58) Field of Classification Search
CPC ..... A47F 2005/165; A47F 5/16; A47F 5/00; A47F 5/0018; A47F 5/0062; A47F 5/0081; A47F 5/0815; A47F 5/0884; A47F 7/00; A47F 7/0021; A47F 7/0028; A47F 7/02; A47F 7/283
See application file for complete search history.

(56) References Cited

U.S. PATENT DOCUMENTS 331,780 A * 12/1885 Eising ..... A47F 7/02 211/85.2
1,827,969 A * 10/1931 Calkins, Jr. ..... A47F 5/12 108/96
4,074,637 A * 2/1978 Lorenzen, Jr. ..... A47F 7/024 109/38
4,300,674 A * 11/1981 Davet ..... A47F 7/024 206/1.5
4,448,304 A * 5/1984 Weinzettel ..... A47F 7/02 206/223
5,482,159 A * 1/1996 Roraback, Jr. ..... E05B 17/0004 206/223
D370,371 S * 6/1996 Davet ..... D6/682.4
D379,410 S * 5/1997 Porcaro ..... D6/682.3
5,758,777 A * 6/1998 Dods ..... A47F 7/142 206/232
7,374,258 B2 5/2008 Bowron
7,905,362 B2 * 3/2011 Slimane ..... A47F 11/04 211/13.1

(Continued)

*Primary Examiner* — Jonathan Liu
*Assistant Examiner* — Devin K Barnett
(74) *Attorney, Agent, or Firm* — Colby Nipper PLLC

(57) ABSTRACT

This document describes a wedge apparatus for retail device display. The techniques described herein provide a seamless graphic panel on an attachment surface that can be used to present any one of a plurality of different hardware devices on a complex plastic-injection molded assembly. The attachment surface of the wedge apparatus includes a single surface with a plurality of hole patterns, each usable for mounting a different hardware device for retail display. The wedge apparatus provides connection points for attachment of an interchangeable graphic panel, which includes a single hole-pattern accommodating one of the plurality of devices to be displayed. The seamless joining of the various parts of the wedge apparatus enables the graphic panel to be wrapped around the wedge apparatus without a seam being visible through the material of the graphic panel.

20 Claims, 14 Drawing Sheets

(56) References Cited

U.S. PATENT DOCUMENTS

| | | | | |
|---|---|---|---|---|
| 7,966,861 | B2 * | 6/2011 | Yee | G01N 3/303 73/12.09 |
| 9,307,847 | B2 * | 4/2016 | De Lecce | A47F 3/14 |
| 10,034,806 | B1 * | 7/2018 | Greenhalgh, Sr. | A61G 7/05 |
| 10,182,652 | B1 * | 1/2019 | Spielmann | A47B 96/021 |
| 10,306,997 | B2 * | 6/2019 | Eizinas | A47F 5/0062 |
| 10,357,119 | B2 * | 7/2019 | Kalm | A47F 7/286 |
| 2007/0267368 | A1 * | 11/2007 | Pappas | A47K 1/09 211/65 |
| 2008/0230010 | A1 * | 9/2008 | Buck | A01K 63/006 119/256 |
| 2009/0129905 | A1 * | 5/2009 | McIntosh | G06F 1/183 414/471 |
| 2012/0205325 | A1 * | 8/2012 | Richter | A47F 7/024 211/4 |
| 2015/0020361 | A1 * | 1/2015 | Van Buskirk | A47F 5/12 29/428 |
| 2015/0346770 | A1 * | 12/2015 | Onda | G06F 1/1626 361/679.06 |
| 2016/0126761 | A1 * | 5/2016 | Sanford | G06F 1/263 320/134 |
| 2016/0261301 | A1 * | 9/2016 | Juni | H04B 1/3877 |
| 2018/0178336 | A1 * | 6/2018 | Gussmann | B23Q 7/10 |
| 2018/0184814 | A1 * | 7/2018 | Nagel | A47F 5/005 |
| 2019/0104867 | A1 * | 4/2019 | Meherin | A47F 7/146 |
| 2019/0197925 | A1 * | 6/2019 | Tewksbury | A47B 57/58 |
| 2021/0204418 | A1 * | 7/2021 | Qin | G09F 13/18 |

* cited by examiner

Section A–A

Section B–B

Section C-C

WEDGE APPARATUS FOR RETAIL DEVICE DISPLAY

BACKGROUND

Hardware devices may be mounted to a mounting structure for retail display. For aesthetic and cosmetic purposes, some such mounting structures may be uniquely designed for a particular device to, for example, hide mounting holes behind the device and to secure the device in a particular orientation. Some of these mounting structures, however, may not be suitable for reuse with a different device that uses different mounting hardware. Further, manufacturing a mounting structure for each particular device for retail display may be expensive both monetarily and materially.

SUMMARY

This document describes a wedge apparatus for retail device display. The techniques described herein provide a seamless graphic panel on an attachment surface that can be used to present any one of a plurality of different hardware devices on a complex plastic-injection molded assembly (e.g., described herein as a wedge subassembly). The attachment surface of the wedge apparatus includes a single surface with a plurality of hole patterns, each usable for mounting a different hardware device for retail display. The wedge apparatus provides connection points for attachment of an interchangeable graphic panel, which includes a single hole-pattern accommodating one of the plurality of devices to be displayed. The seamless joining of the various parts of the wedge apparatus enables the graphic panel to be wrapped around the wedge apparatus without any seam being visible through the material of the graphic panel.

The graphic panel also hides the other hole patterns that do not correspond to the device that is to be mounted to the wedge apparatus, resulting in a cosmetically clean display. In some instances, the graphic panel may not include any hole pattern, thereby providing a surface area for a printed graphic presentation. The graphic panel is interchangeable with another graphic panel having a different hole pattern corresponding to a different device to be mounted to the wedge apparatus. In this way, the wedge apparatus provides a single display that can accommodate numerous devices, which reduces monetary and material costs.

In aspects, a wedge apparatus for retail device display is disclosed. The wedge apparatus includes a body, a faceplate, and an interchangeable graphic panel. The body has a tapered cross section, including a bottom side for attachment to a mounting surface, a rear side connected to the bottom side, and a front side connected to both the rear side and the bottom side. The faceplate is assembled to the front side of the body. Further, the faceplate defines a plurality of hole patterns, including at least first and second hole patterns. The first hole pattern corresponds to a first configuration of mounting hardware for a first retail device. The second hole pattern corresponds to a second configuration of mounting hardware for a second retail device that is different than the first configuration. Further, the faceplate is oriented at an acute angle relative to the bottom side to enable presentation of corresponding retail devices at a predefined angle from the mounting surface. The graphic panel is configured to wrap around the body to substantially cover the front side, the bottom side, and the rear side. The graphic panel also includes a hole pattern that is substantially the same shape and size as one of the plurality of hole patterns on the faceplate.

This summary is provided to introduce simplified concepts of a wedge apparatus for retail device display. Such concepts are further described below in the Detailed Description. This summary is not intended to identify essential features of the claimed subject matter, nor is it intended for use in determining the scope of the claimed subject matter.

BRIEF DESCRIPTION OF THE DRAWINGS

The details of one or more aspects of a wedge apparatus for retail device display are described in this document with reference to the following drawings. The same numbers are used throughout the drawings to reference like features and components.

DETAILED DESCRIPTION

This document describes a wedge apparatus for retail device display. The wedge apparatus provides multiple options for device displays on a single surface. For example, the wedge apparatus includes a wedge subassembly having a faceplate with multiple different hole patterns (e.g., through holes) that correspond to different configurations of mounting hardware for different devices. The wedge apparatus also includes a low-cost, interchangeable graphic panel that defines a hole pattern matching a configuration of mounting hardware of a particular device that is to be mounted on the wedge apparatus. In this way, the graphic panel covers other hole patterns that are not used for mounting the particular device to the wedge apparatus. Further, the graphic panel is removably secured to the wedge subassembly by protrusions located on an interior surface of the wedge subassembly that are accessible via an access panel on a rear side of the wedge subassembly. Accordingly, the wedge apparatus provides multiple options for device displays on a single surface in a way that hides cosmetic defects and unused hole patterns, is reusable for mounting different devices having different configurations of mounting hardware, and is serviceable.

While features and concepts of the described wedge apparatus for retail device display can be implemented in any number of different environments, aspects are described in the context of the following examples.

Example Apparatus

Figure 1:
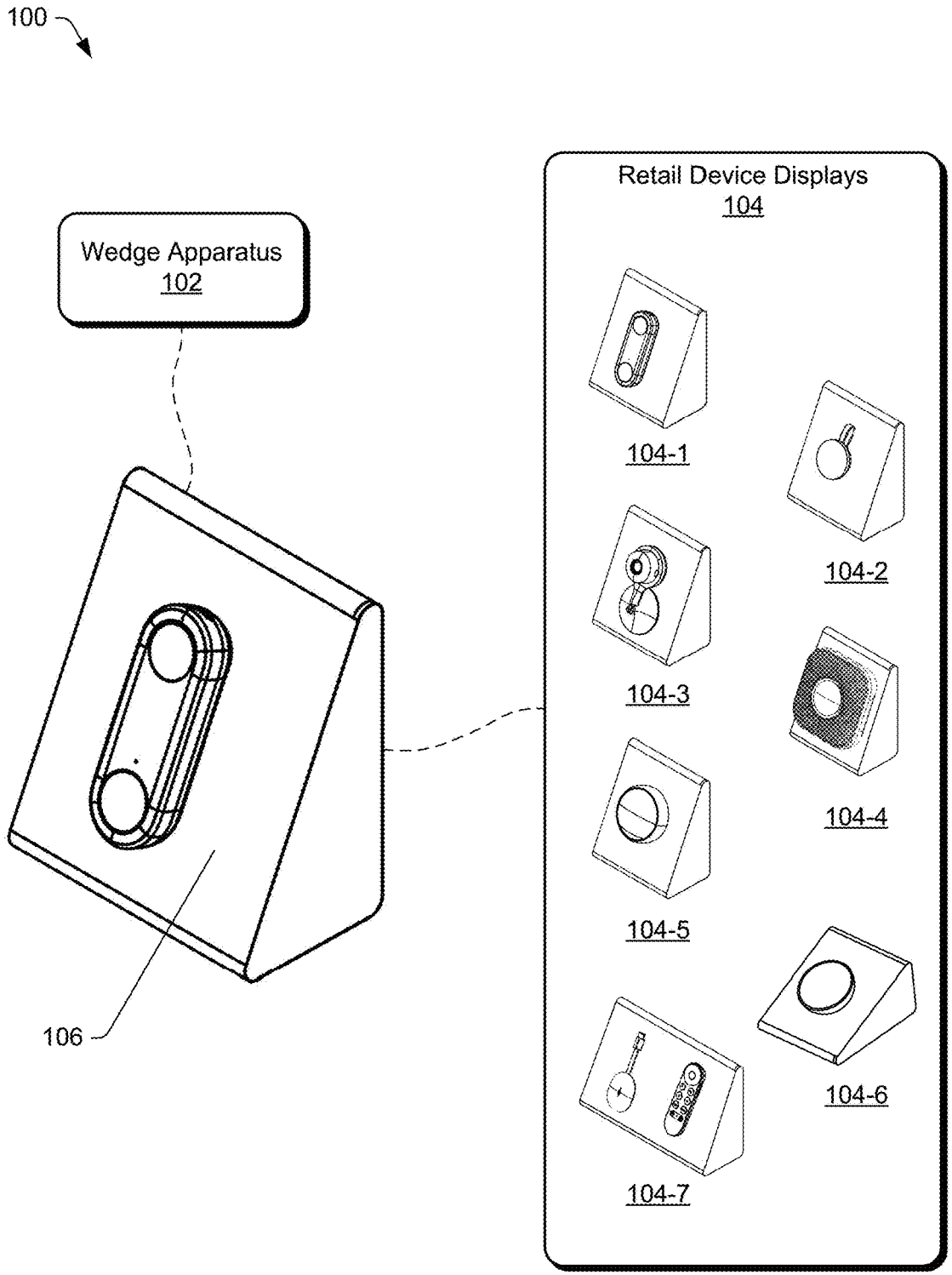
FIG. 1 illustrates an example implementation of a wedge apparatus capable of multiple device presentations on a single surface.

FIG. 1 illustrates an example implementation 100 of a wedge apparatus 102 that provides multiple options for device presentations on a single surface. For example, the wedge apparatus 102 is shown as providing a retail device display 104 for a variety of devices, including a video-recording doorbell display 104-1, a media-streaming device display 104-2, an indoor camera display 104-3, a speaker display 104-4, an electronic thermostat display 104-5, a light-generating device display 104-6, and a side-by-side device display 104-7. In some instances (e.g., the displays 104-1 through 104-5), the wedge apparatus 102 may have a vertical orientation for a semi-vertical presentation of the mounted device. In other instances (e.g., the display 104-6), the wedge apparatus 102 may have a horizontal orientation for a semi-horizontal presentation of the mounted device. The wedge apparatus 102 may also be configured for mounting multiple devices (e.g., the display 104-7) for display side-by-side.

As further described herein, the wedge apparatus 102 includes a plurality of hole patterns hidden under a graphic panel 106 that is wrapped around a wedge subassembly. The graphic panel 106 is interchangeable and effectively hides unused hole patterns while defining a hole pattern specific to the device(s) to be mounted to the wedge apparatus 102.

Figure 2:
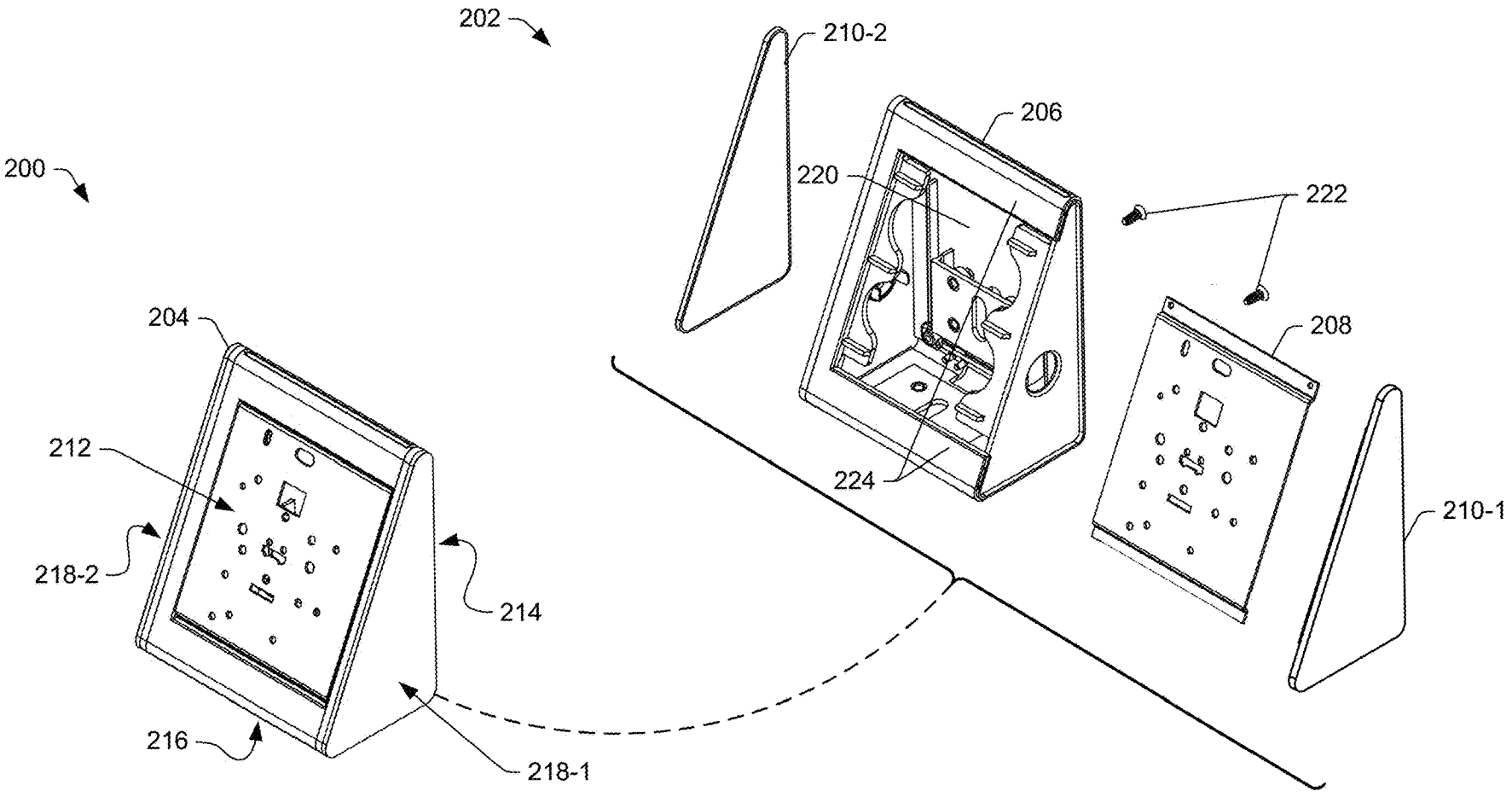
FIG. 2 illustrates a front isometric view and an exploded view of an example implementation of a wedge subassembly of the wedge apparatus from FIG. 1.

Consider FIG. 2, which illustrates a front isometric view 200 and an exploded view 202 showing an example implementation of a wedge subassembly 204 of the wedge apparatus 102 from FIG. 1. In this example, the graphic panel 106 from FIG. 1 has been removed for illustration of the wedge subassembly 204. The wedge subassembly 204 includes a body 206, a faceplate 208, and end caps 210 (e.g., first end cap 210-1 and second end cap 210-2). As described herein, the body 206 includes a front side 212, a rear side 214, a bottom side 216, and two opposing lateral sides 218 (including lateral sides 218-1 and 218-2) that are substantially orthogonal to each of the front side 212, the rear side 214, and the bottom side 216. The bottom side 216 is connected to the rear side 214 and is substantially orthogonal to the rear side 214. The front side 212 is connected to both the bottom side 216 and the rear side 214, forming a wedge shape (e.g., triangular shape in a side view). The bottom side 216 may rest on or be attached to a mounting surface (e.g., table, shelf). In some aspects, the bottom side 216 and the rear side 214 are interchangeable with one another in that the rear side 214 can be used as the bottom side (e.g., mounted to a surface), and the bottom side 216 can be used as the rear side (e.g., backside of the apparatus).

On the rear side 214, the body 206 includes an access panel 220 that is openable to provide access to an interior of the body 206. The access panel can be secured in a closed position by one or more mechanical fasteners 222 (e.g., screws).

The faceplate 208 may be removably assembled (e.g., slidably assembled) to the front side 212 of the body 206. For example, the body 206 includes one or more flanges 224 that overlap a portion of the faceplate 208 to secure faceplate 208 to the body 206. This assembly architecture may enable quick disassembly of the faceplate 208 from the body 206. When assembled to the body 206, the faceplate 208 is oriented at an acute angle relative to the bottom side 216 to enable presentation of the mounted retail device at a predefined angle from the mounting surface. Depending on the orientation of the wedge apparatus 102, the acute angle may be between approximately 45 degrees and approximately 90 degrees for a semi-vertical presentation of the mounted retail device, or the acute angle may be between approximately zero degrees and approximately 45 degrees for a semi-horizontal display of the mounted retail device.

Figure 3:
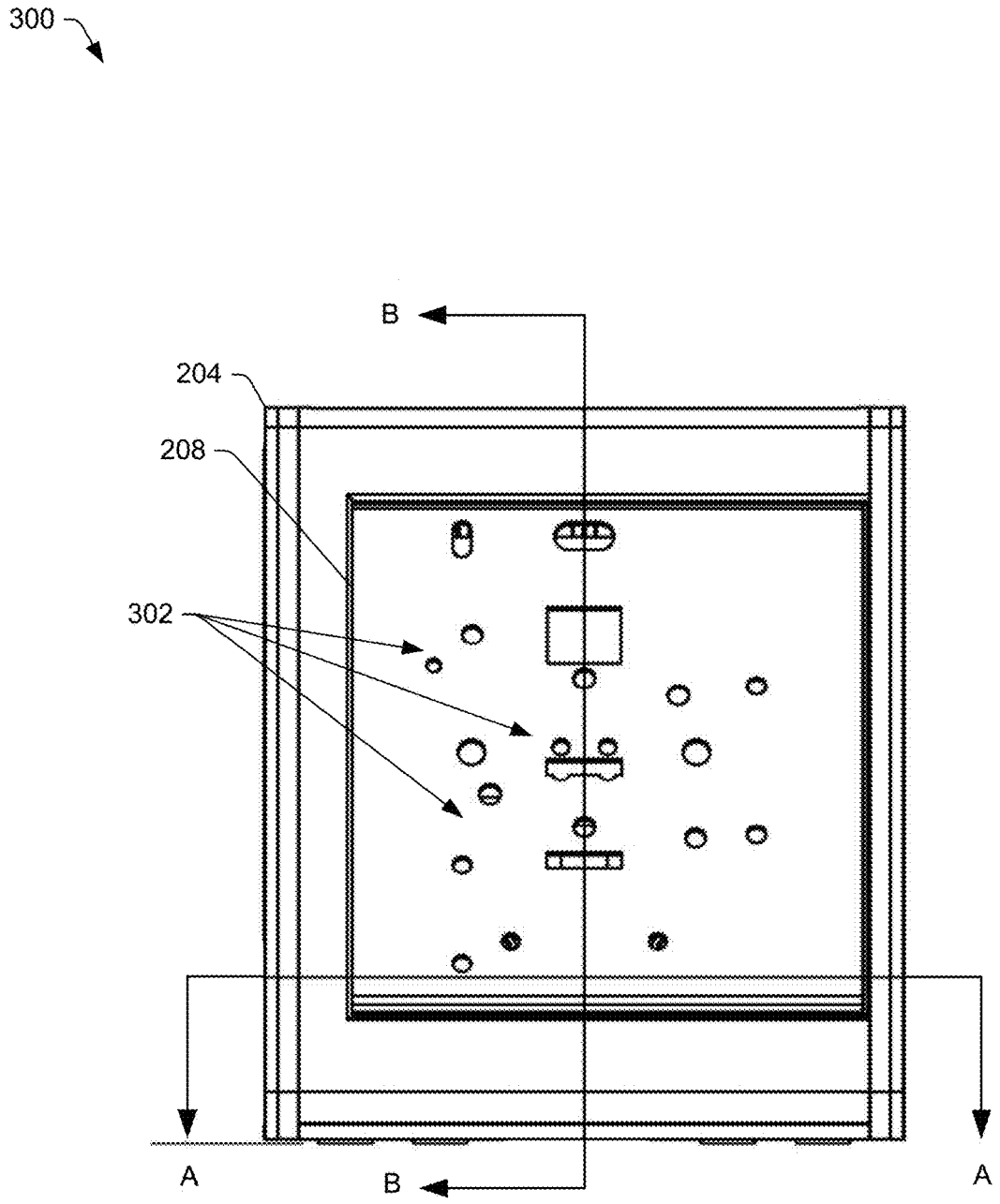
FIG. 3 illustrates a front elevational view of the wedge subassembly from FIG. 2.

FIG. 3 illustrates a front elevational view 300 of the wedge subassembly from FIG. 2. As described in more detail below, the faceplate 208 includes a plurality of hole patterns 302, each hole pattern 302 including one or more holes that are positioned to correspond to a configuration of mounting hardware for a particular device that may be mounted to the wedge subassembly 204. At least some of the hole patterns may overlap one another. Including the plurality of hole patterns 302 enables any one of a plurality of devices (e.g., the retail devices 104 in FIG. 1) to be removably mounted, using hardware fasteners, to the faceplate 208 for retail display. Further, the mounted device may be disassembled from the wedge subassembly 204, and the wedge apparatus may be reused to mount a different device having a different configuration of mounting hardware.

Figure 4:
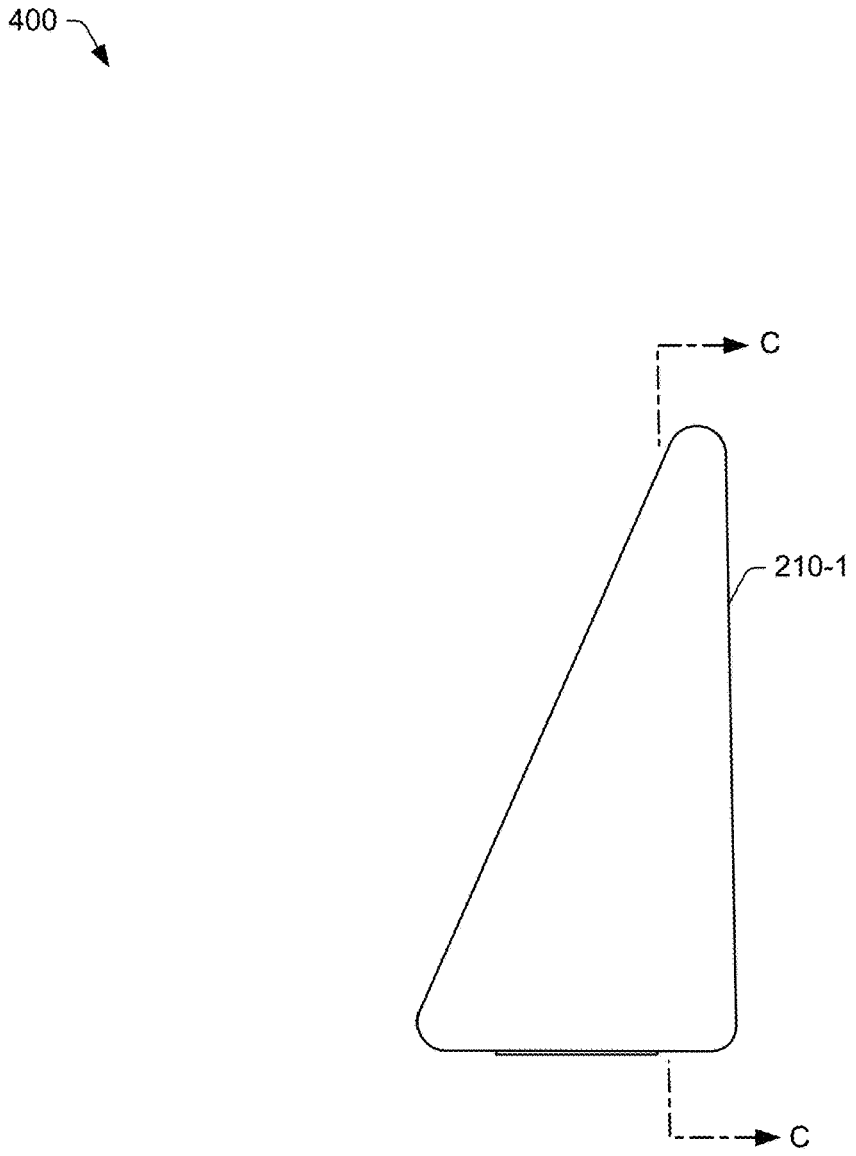
FIG. 4 illustrates a right elevational view of the wedge subassembly from FIG. 2.
Figure 5:
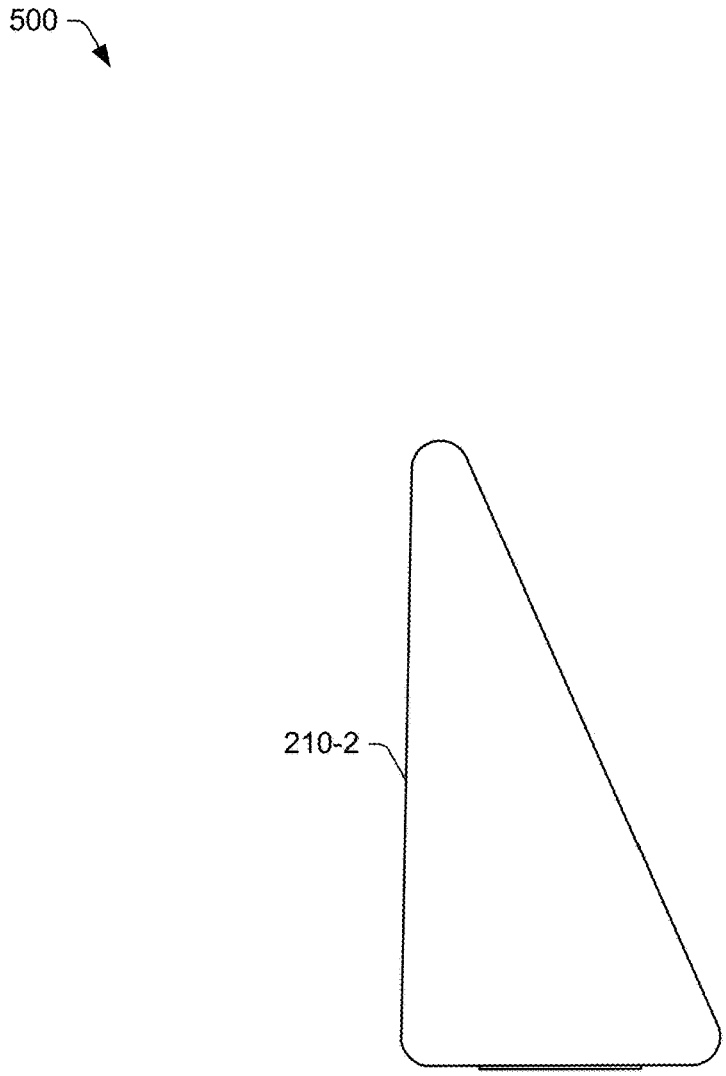
FIG. 5 illustrates a left elevational view of the wedge subassembly from FIG. 2.

FIG. 4 illustrates a right elevational view 400 of the wedge subassembly 204 from FIG. 2. The right elevational view 400 shows the first end cap 210-1. FIG. 5 illustrates a left elevational view 500 of the wedge subassembly 204 from FIG. 2. The left elevational view 500 shows the second end cap 210-2.

Figure 6:
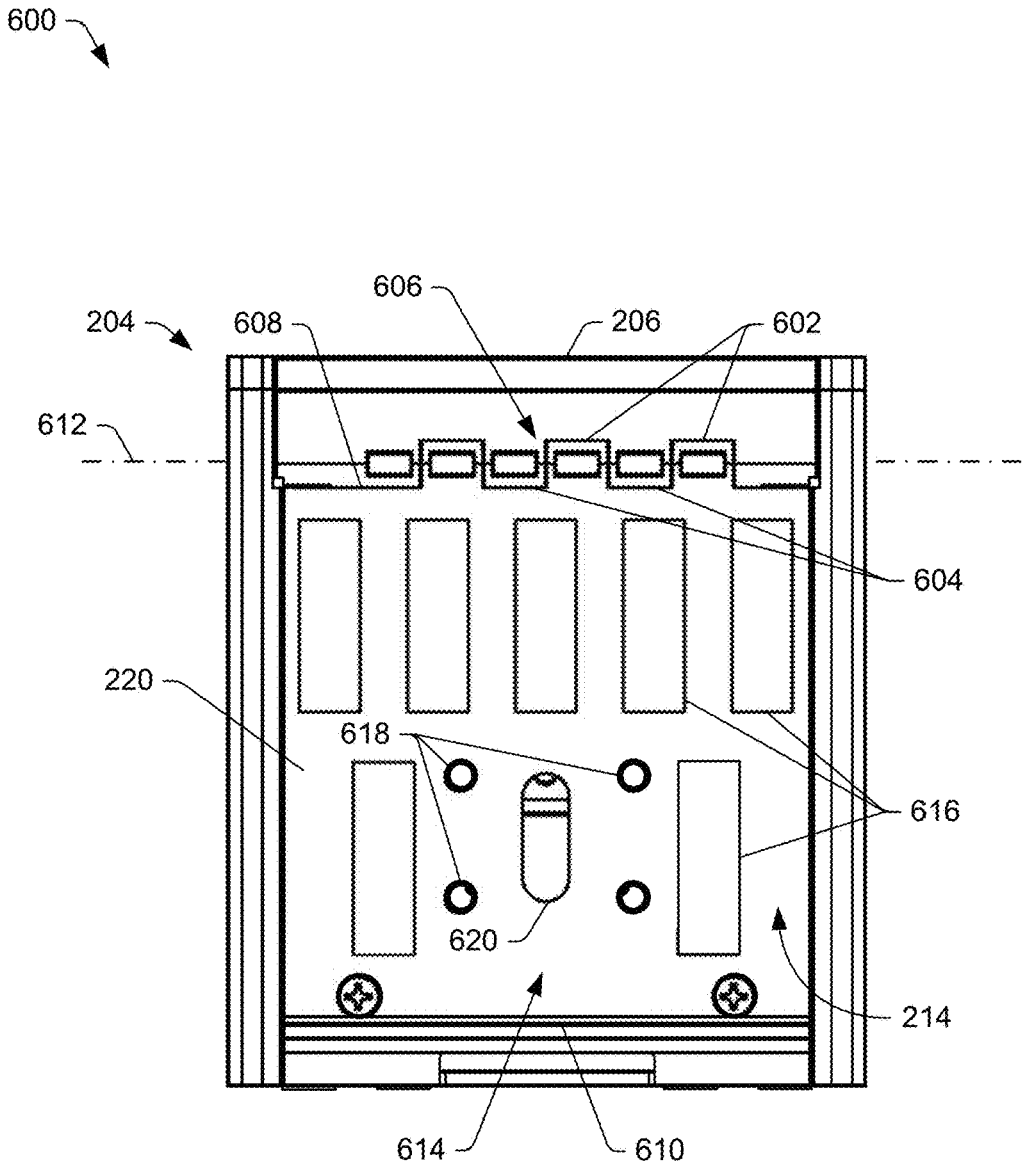
FIG. 6 illustrates a rear elevational view of the wedge subassembly from FIG. 2.

FIG. 6 illustrates a rear elevational view 600 of the wedge subassembly 204 from FIG. 2, showing the rear side 214 of the wedge subassembly 204. The access panel 220 is connected to the body 206. For example, the access panel 220 may include a first hinge portion 602 that mates with a second hinge portion 604 on the body 206 to form a hinged connection 606. The first hinge portion 602 may be positioned at a first edge 608 of the access panel 220 to enable an opposing, second edge 610 of the access panel to radially move about an axis 612 of the hinged connection between an open position and a closed position. In addition, the access panel 220 may be secured in a closed position by one or more of the mechanical fasteners 222.

Opening the access panel 220 provides access to the interior of the body 206, which enables a user to access mounting hardware used to mount a device to the wedge subassembly 204 and also cables (e.g., power cable) of the mounted device that pass through the interior of the body 206. For example, a mounted electronic device may have a power cord connected to the device. The power cord may extend through the front side of the wedge subassembly into the interior of the body 206 and further down through the bottom side of the wedge subassembly 204 (and through a hole in the surface upon which the wedge apparatus is mounted) to connect to a power supply. This may effectively hide the power cord from viewers of the retail display.

An exterior surface 614 of the access panel 220 may include multiple regions 616 for locating adhesive, including double-sided tape, for bonding the rear side 214 to a surface. Additionally or alternatively, the access panel 220 may also include threaded inserts 618 or other mechanical fasteners usable to mechanically mount the rear side 214 to the surface. Using strong adhesive and/or a mechanical fasteners to mount the wedge apparatus 102 to a surface can reduce the likelihood of theft. Further, the access panel 220 may define a through hole 620, through which a power cable of a mounted device may extend to connect the mounted device to a power source. This may enable the mounted device to be displayed with the power cord hidden by the wedge apparatus 102.

Figure 7:
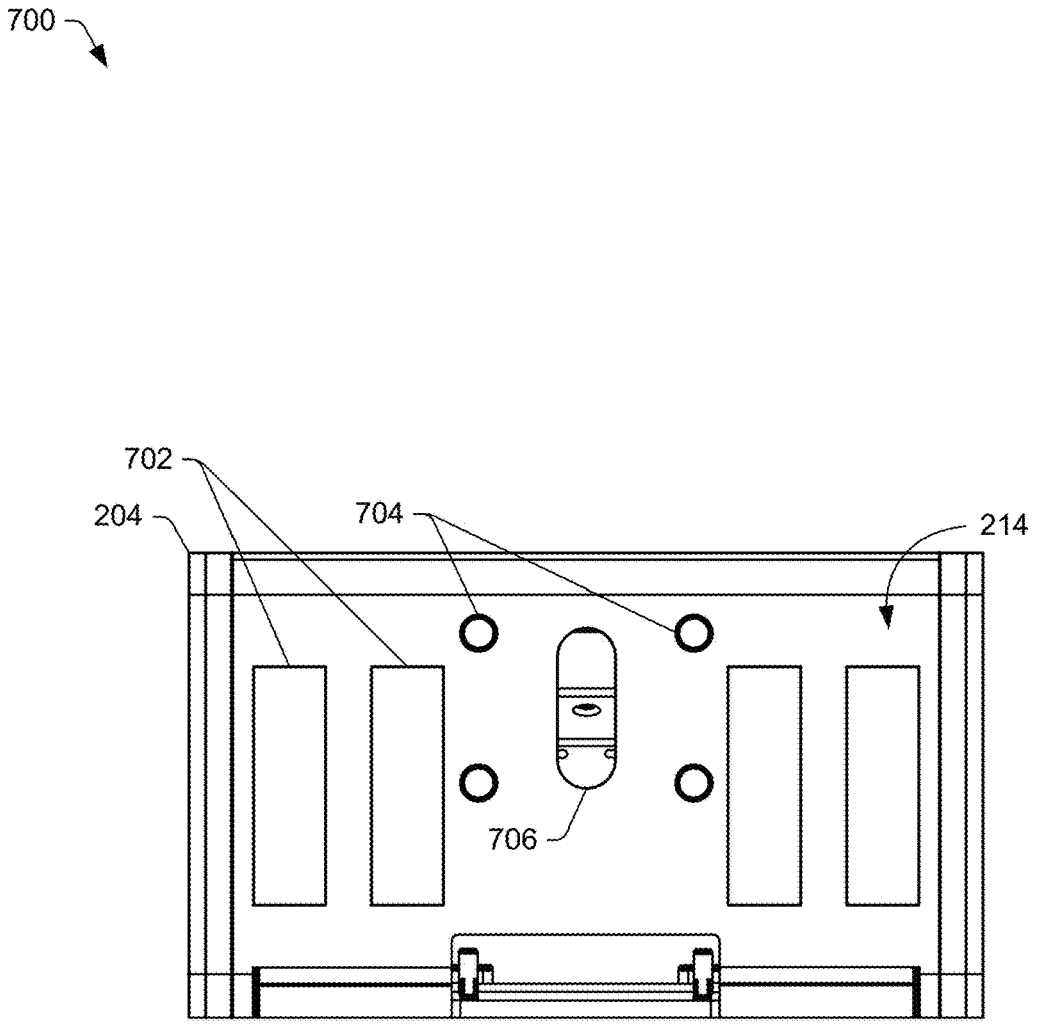
FIG. 7 illustrates a bottom plan view of the wedge subassembly from FIG. 2.

FIG. 7 illustrates a bottom plan view 700 of the wedge subassembly 204 from FIG. 2, which shows the bottom side 216 of the wedge subassembly 204. Similar to the rear side 214 in FIG. 6, the bottom side 216 includes multiple regions 702 for locating adhesive for bonding the bottom side 216 to a surface. Additionally or alternatively, the bottom side 216 may also include threaded inserts 704 or other mechanical fasteners usable to mechanically mount the bottom side 216 to the surface. Further, the bottom side 216 may define a through hole 706, through which a power cable of a mounted device may extend to connect the mounted device to a power source.

In this way, the wedge subassembly 204 can be mounted to a surface on either the bottom side 216 or the rear side 214, which provides options for how the mounted device is to be displayed (e.g., a semi-vertical orientation or a semi-horizontal orientation).

Figure 8:
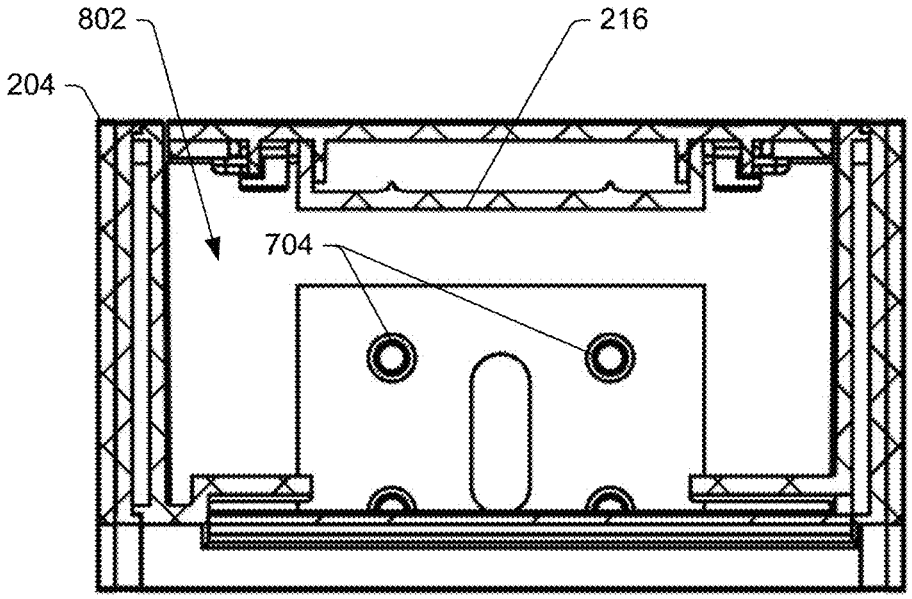
FIG. 8 illustrates a sectional view of the wedge subassembly, taken along line A-A of FIG. 3.

FIG. 8 illustrates a sectional view 800 of the wedge subassembly 204, taken along line A-A of FIG. 3. This section view 800 shows an inner surface 802 of the bottom side 216 (from FIG. 2) of the wedge subassembly 204. The threaded inserts 704 may be positioned on the inner surface 802 of the bottom side 216. In another example, rather than using the threaded inserts 704, through holes may be implemented on the bottom side 216 to enable a bolt to be inserted through the through hole and connected to a nut located in the interior of the body 206.

Figure 9:
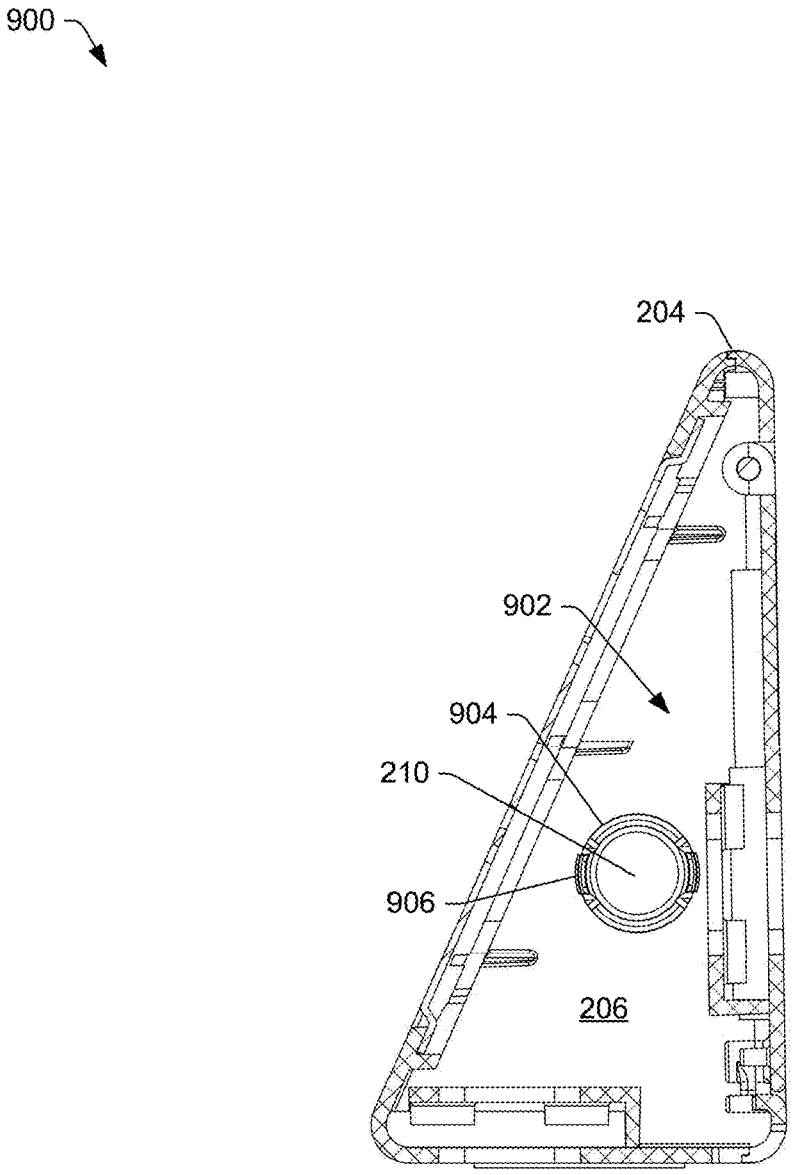
FIG. 9 illustrates a sectional view of the wedge subassembly, taken along line B-B of FIG. 3.

FIG. 9 illustrates a sectional view 900 of the wedge subassembly 204, taken along line B-B of FIG. 3. This sectional view 900 illustrates a side view of the interior of the body 206. For example, an inner surface 902 of the body 206, on the lateral side 218 (from FIG. 2), may define one or more holes (e.g., hole 904). The end cap 210 may include one or more push tabs 906 configured to extend through the hole 904, bias against the side of the hole 904, and overlap a portion of the inner surface 902 of the body 206 to "snap" or "clip" into place. In this way, the push tab 906 removably secures the end cap 210 to the lateral side 218 of the body 206.

Figure 10:
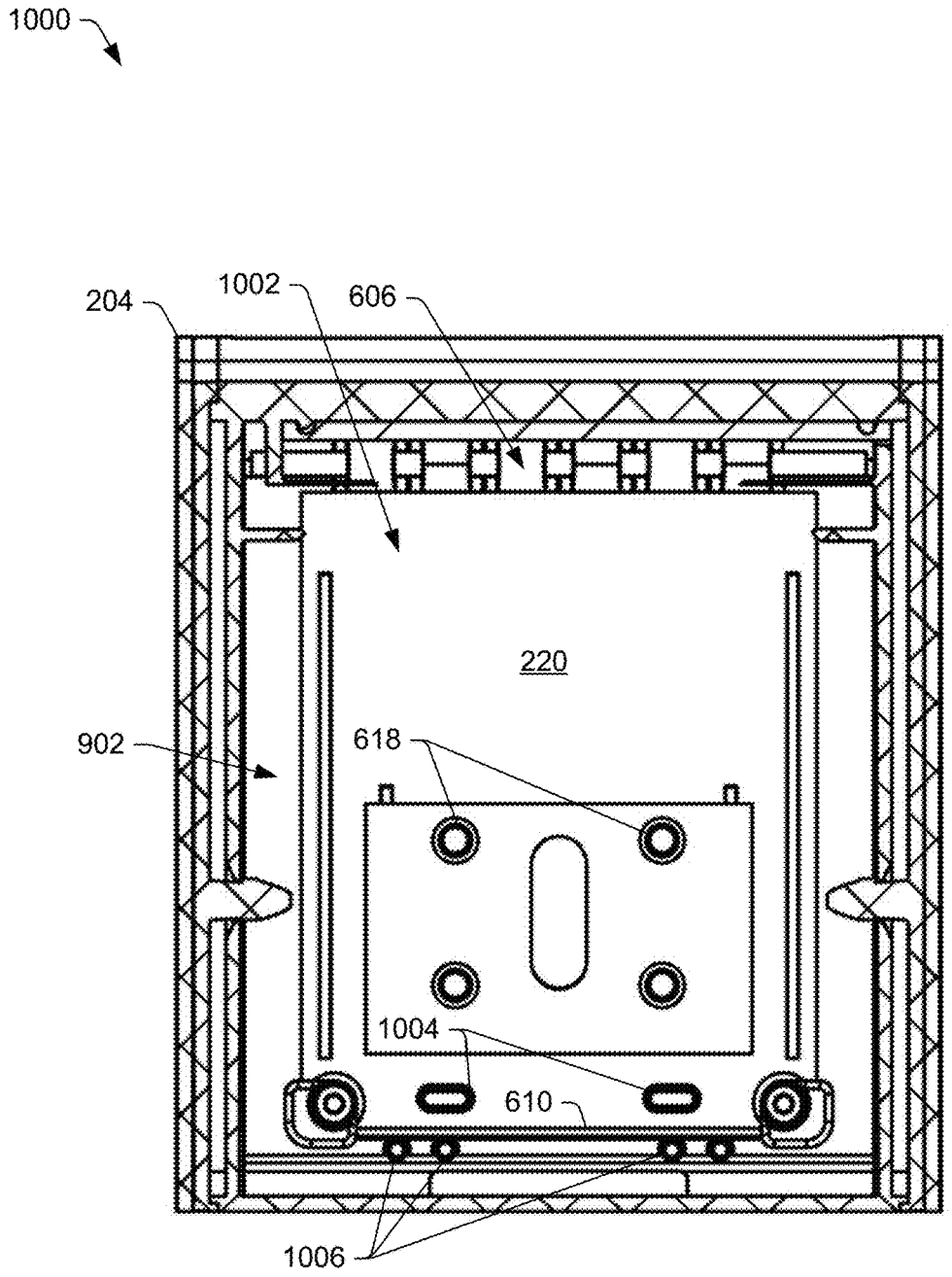
FIG. 10 illustrates a sectional view of the wedge subassembly, taken along line C-C of FIG. 4.

FIG. 10 illustrates a sectional view 1000 of the wedge subassembly 204, taken along line C-C of FIG. 4. This sectional view 1000 shows an inner surface 1002 of the access panel 220. Attached to the inner surface 1002 of the access panel 220 are threaded inserts (e.g., the threaded inserts 618 described in relation to FIG. 6). The wedge subassembly 204 includes a first set of protrusions 1004 located on the inner surface 1002 of the access panel 220. The wedge subassembly 204 also includes a second set of protrusions 1006 located on the inner surface 902 of the body 206, on the rear side 214, and proximate to the access panel 220. Both sets of protrusions 1004 and 1006 are located proximate to one another and proximate to the second edge 610 of the access panel 220 that is opposite the hinged connection 606. The combination of the first and second sets of protrusions 1004 and 1006 may be usable to retain the graphic panel 106 (from FIG. 1) to the wedge subassembly 204. In aspects, the first and second sets of protrusions 1004 and 1006 are configured to provide a tension force to the graphic panel 106 when the access panel 220 is in the closed position.

Figure 11:
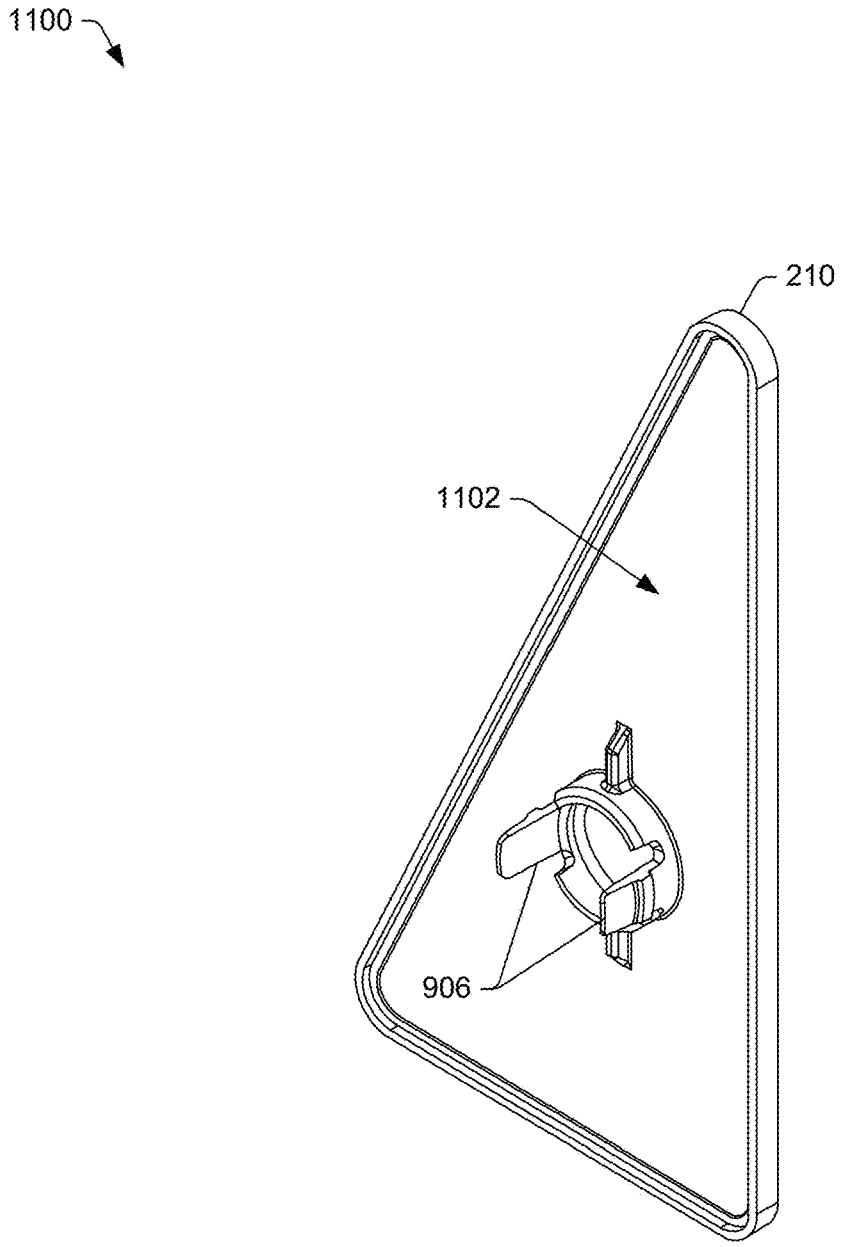
FIG. 11 illustrates an isometric view of an interior of the end cap from FIG. 2.

FIG. 11 illustrates an isometric view 1100 of an interior of the end cap 210 from FIG. 2. The end cap 210 includes the push tab 906 on an inner surface 1102 of the end cap 210. Any suitable locking mechanism may be used to secure the end cap 210 to the body 206 (from FIG. 2). In this example, the push tab 906 extends from the inner surface 1102 of the end cap 210. The push tab 906 is configured to "snap" to the body 206 to retain the end cap 210 to the body 206. The push tab 906 may then be accessible via the interior of the body 206 to release the push tab 906 and disassemble the end cap 210 from the body 206.

Figure 12:
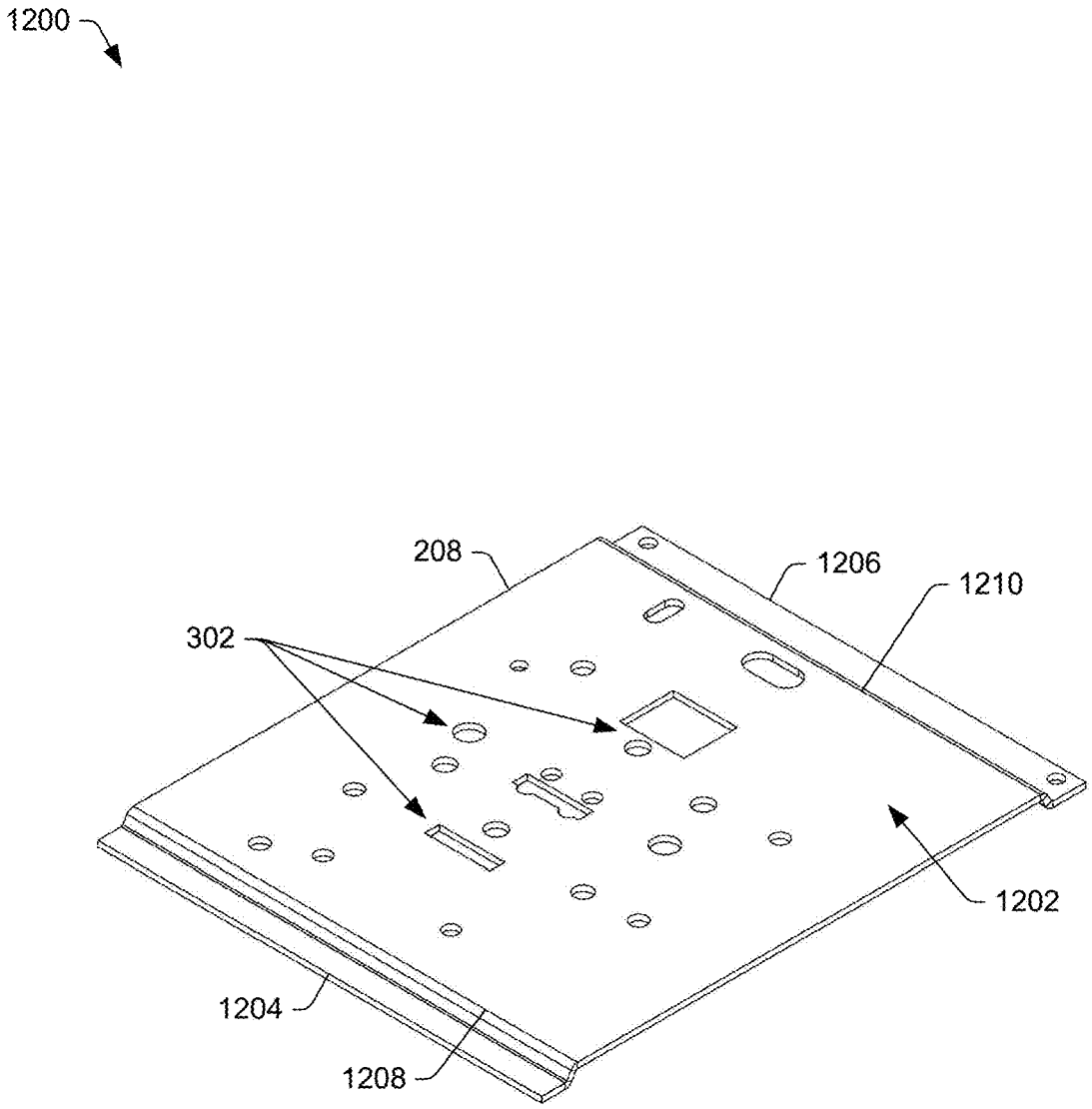
FIG. 12 illustrates an isometric view of the faceplate from FIG. 2.

FIG. 12 illustrates an isometric view 1200 of the faceplate 208 from FIG. 2. As described, the faceplate 208 includes a plurality of hole patterns 302 that are each defined for a different configuration of mounting hardware for a device to be mounted to the faceplate 208. The faceplate 208 has a substantially planar surface 1202, which includes the plurality of hole patterns 302. At least some of the hole patterns 302 may overlap one another, enabling different devices using different configurations of mounting hardware to be mounted, one at a time, in the same location on the faceplate 208. The faceplate 208 also includes one or more flanges (e.g., flange 1204 and flange 1206) extending outward from opposing edges 1208 and 1210, respectively, of the faceplate 208. The flanges 1204 are configured to mate with the flanges 224 on the body 206 (shown in FIG. 2) to slidably assemble and retain the faceplate 208 to the body 206.

Figure 13:
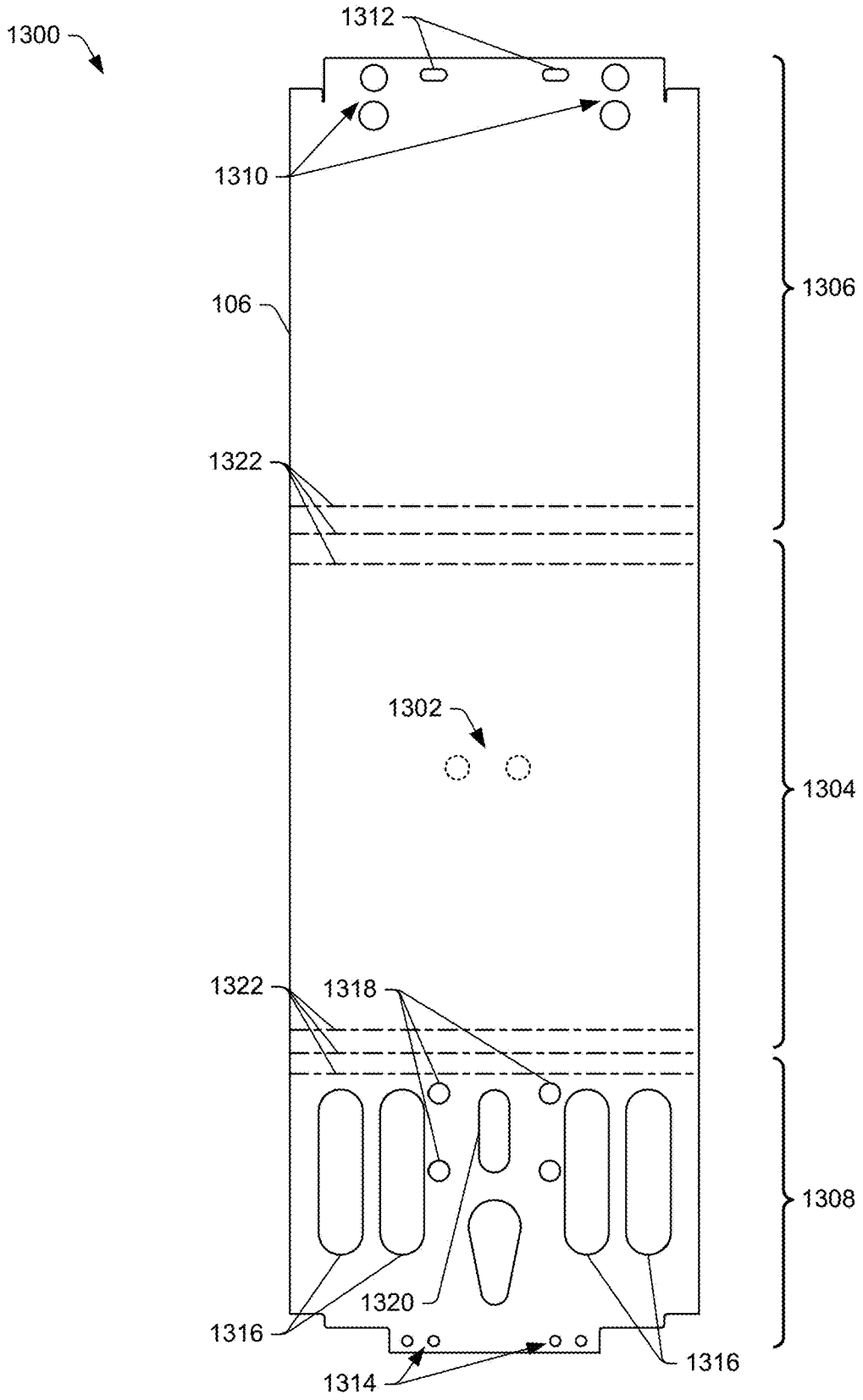
FIG. 13 illustrates an example implementation of the graphic panel from FIG. 1.

FIG. 13 illustrates an example implementation 1300 of the graphic panel 106 from FIG. 1. The graphic panel 106 is a flexible material that can be wrapped around the wedge subassembly 204 (shown in FIG. 1). The graphic panel 106 includes a single hole pattern (e.g., hole pattern 1302) that corresponds to a configuration of mounting hardware for a particular device that is mountable to the wedge subassembly 204. Different graphic panels 106 may have different hole patterns, depending on the device with which the graphic panel 106 is associated.

The graphic panel 106 includes several sections. For example, the graphic panel 106 includes a first section 1304 between a second section 1306 and a third section 1308. The first section 1304 is configured to cover the front side 212 of the wedge subassembly 204 (shown in FIG. 2). The second section 1306 is configured to substantially cover the rear side 214 of the body 206, including the access panel 220 (shown in FIG. 2). The third section 1308 is configured to substantially cover the bottom side 216 of the body 206 and a portion of the rear side 214 of the body 206 (shown in FIG. 2). The second section 1306 includes a set of holes (e.g., holes 1310) that correspond to locations on the access panel 220 used for the mechanical fasteners 222 (shown in FIG. 2). The second section 1306 also includes another set of holes (e.g., holes 1312) usable to hook the graphic panel 106 onto the first set of protrusions 1004 located on the inner surface 1002 of the access panel 220 (shown in FIG. 10).

The third section 1308 includes a set of holes (e.g., holes 1314), which are configured to hook the graphic panel 106 onto the second set of protrusions 1006 located in the inner surface 902 of the body 206 (shown in FIG. 10). The third section 1308 may include another set of holes (e.g., holes 1316) that correspond to locations on the body 206 where adhesive may be used to bond the body 206 to a surface. The holes 1316 may be elongated in a lengthwise direction of the graphic panel 106 to accommodate the adhesive and to prevent puckering from occurring in the graphic panel 106 when tension is applied to the graphic panel 106. The third section 1308 may also include a set of holes (e.g., holes 1318) corresponding to locations on the body 206 for mechanical fasteners (e.g., the threaded inserts 704) to be used to fasten the body 206 to a surface. The third section 1308 may also include a hole 1320 corresponding to a location on the body 206 through which a mounted device's power cord is passed. In some implementations, the holes 1316, the holes 1318, and/or the hole 1320 may be defined in the second section 1306 if the rear side 214 is to be mounted to a surface. Additionally, the illustrated example includes dashed lines 1322 representing areas of the graphic panel 106 that wrap around corners of the wedge subassembly 204 between the front side 212 and the bottom side 216 and between the front side 212 and the rear side 214.

Figure 14:
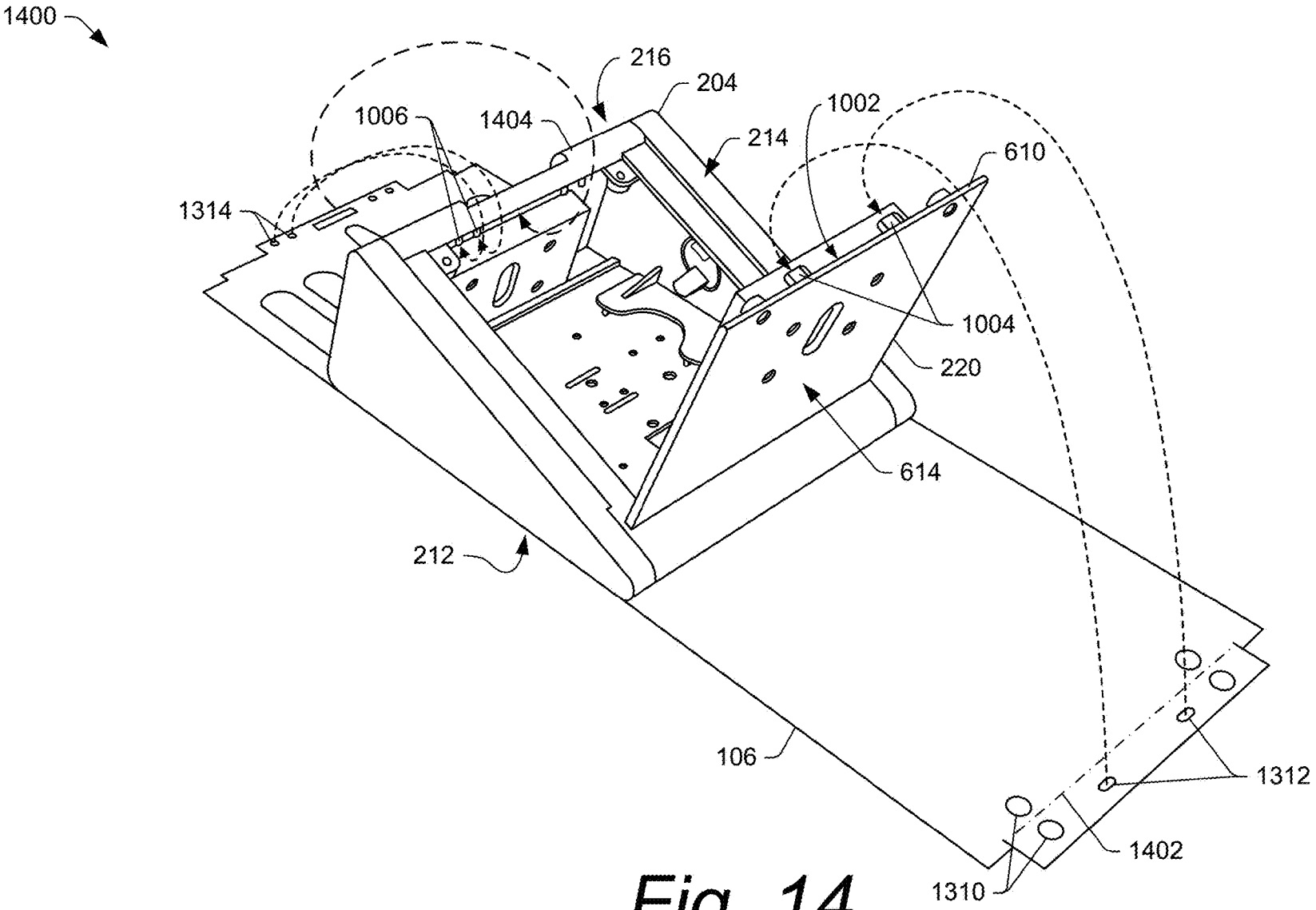
FIG. 14 illustrates an example implementation of the graphic panel being assembled to the wedge subassembly.

FIG. 14 illustrates an example implementation 1400 of the graphic panel 106 being assembled to the wedge subassembly 204. In the illustrated example, the access panel 220 is in an open position. The graphic panel 106 is wrapped around the wedge subassembly 204 such that (i) the holes 1312 are hooked onto the first set of protrusions 1004 positioned on the inner surface 1002 of the access panel 220, (ii) the holes 1314 are hooked onto the second set of protrusions 1006 positioned on the inner surface 902 of the body 206 and proximate to the bottom side 216, and (iii) the graphic panel 106 is positioned to cover the exterior surface 614 of the access panel 220, the front side 212 of the wedge subassembly 204, and the bottom side 216 of the wedge subassembly 204. The graphic panel 106 wraps around the second edge 610 of the access panel 220 (e.g., at a location approximated by dashed line 1402). The graphic panel 106 also wraps around a corner (e.g., corner 1404) of the wedge subassembly 204 that is between the bottom side 216 and the rear side 214.

When the access panel 220 is moved to the closed position, the first and second sets of protrusions 1004 and 1006 together apply tension to the graphic panel 106 to tightly fit the graphic panel 106 around the wedge subassembly 204. In this way, the only seam visible is proximate to the second edge 610 of the access panel where opposing ends of the graphic panel 106 (e.g., the ends having the holes 1312 and the holes 1314) are routed into the interior of the wedge subassembly 204. Further, the graphic panel 106 is easily interchangeable with another graphic panel 106 having a different hole pattern corresponding to a different device's configuration of mounting hardware. The graphic panel 106 is assembled to the wedge subassembly 204 without using adhesive that may increase the difficulty of disassembly (e.g., for reworking or recycling). The architecture of the wedge apparatus 102 is such that assembly can be quick and easy to perform, which may be required in some retail situations that have limited time for setup and assembly.

CONCLUSION

Although aspects of the wedge apparatus for retail device display have been described in language specific to features and/or methods, the subject of the appended claims is not necessarily limited to the specific features or methods described. Rather, the specific features and methods are disclosed as example implementations of the claimed wedge apparatus for retail device display, and other equivalent features and methods are intended to be within the scope of the appended claims. Further, various different aspects are described, and it is to be appreciated that each described aspect can be implemented independently or in connection with one or more other described aspects.

What is claimed is:

1. A wedge apparatus for retail device display, the wedge apparatus comprising: a body having a tapered cross section including a bottom side for attachment to a mounting surface, a rear side connected to the bottom side, and a front side connected to both the rear side and the bottom side;

a faceplate assembled to the front side of the body, the faceplate defining a plurality of hole patterns including at least first and second hole patterns, the first hole pattern corresponding to a first configuration of mounting hardware for a first retail device, the second hole pattern corresponding to a second configuration of mounting hardware for a second retail device that is different than the first configuration, the faceplate oriented at an acute angle relative to the bottom side to enable presentation of corresponding retail devices at a predefined angle from the mounting surface; and an interchangeable graphic panel configured to wrap around the body to substantially cover the front side, the bottom side, and the rear side, the graphic panel including a hole pattern that is substantially the same shape and size as one of the plurality of hole patterns on the faceplate.

2. The wedge apparatus of claim 1, wherein the faceplate comprises a panel that is slidably assembled to the front side of the body via one or more flanges on the body.

3. The wedge apparatus of claim 1, wherein the graphic panel is configured to:

cover the front side and the faceplate; and provide access to only the one of the plurality of hole patterns on the faceplate that corresponds to the hole pattern in the graphic panel.

4. The wedge apparatus of claim 1, wherein:

the acute angle is between approximately 45 degrees and approximately 89 degrees for a semi-vertical presentation of the mounted retail device; or the acute angle is between approximately 10 degrees and approximately 45 degrees for a semi-horizontal display of the mounted retail device.

5. The wedge apparatus of claim 1, wherein the rear side includes an access panel connected to the body via a hinged connection and configured to provide access to an interior of the body.

6. The wedge apparatus of claim 5, wherein:

the body includes a first set of protrusions located on an inner surface of the body, on the rear side, and proximate to the access panel;

the access panel includes a second set of protrusions located on an inner surface of the access panel; and the first and second sets of protrusions are configured to protrude through mounting holes defined at opposing ends of the graphic panel to secure the graphic panel to the body.

7. The wedge apparatus of claim 6, wherein:

the access panel includes opposing first and second edges;

the first edge is connected to the hinged connection; and the second set of protrusions is located proximate to the second edge.

8. The wedge apparatus of claim 7, wherein the access panel provides tension to the graphic panel when the access panel is closed.

9. The wedge apparatus of claim 1, further comprising:

first and second end caps configured to cover opposing sides of the body that are substantially orthogonal to the front side, the bottom side, and the rear side, wherein:

at least one of the first and second end caps is configured to secure the faceplate to the body; and each end cap of the first and second end caps includes an interior surface having a push tab extending from the interior surface, the push tab configured to removably secure the end cap to the body.

10. The wedge apparatus of claim 1, wherein the body is plastic-injection molded.

11. The wedge apparatus of claim 1, wherein the faceplate is a metal material.

12. The wedge apparatus of claim 1, wherein the graphic panel defines additional holes to accommodate at least one of:

a set of mechanical fasteners used to attach the wedge apparatus to the mounting surface via threaded inserts located on the bottom side of the body; or an adhesive attached to the bottom side of the body to bond the bottom side to the mounting surface.

13. The wedge apparatus of claim 12, wherein the graphic panel defines the additional holes to accommodate both the set of mechanical fasteners and the adhesive.

14. The wedge apparatus of claim 12, wherein:

the additional holes correspond to the adhesive attached to the bottom side of the body; and the additional holes are elongated in a lengthwise direction of the graphic panel.

15. The wedge apparatus of claim 12, wherein the body includes the threaded inserts on the bottom side of the body and additional threaded inserts on the rear side of the body to enable the wedge apparatus to be mounted to the mounting surface in either a vertical orientation for a semi-vertical presentation of the corresponding retail devices or a horizontal orientation for a semi-horizontal presentation of the corresponding retail devices.

16. The wedge apparatus of claim 1, wherein the graphic panel is a flexible plastic.

17. The wedge apparatus of claim 1, wherein the graphic panel covers hole patterns of the plurality of hole patterns in the faceplate that do not correspond to the corresponding retail devices.

18. The wedge apparatus of claim 1, wherein the first and second hole patterns overlap one another.

19. The wedge apparatus of claim 1, wherein:

the hole pattern in the graphic panel matches the first hole pattern corresponding to the first configuration of mounting hardware for the first retail device; and the graphic panel is interchangeable with a second graphic panel having a different hole pattern that matches the second hole pattern corresponding to the second configuration of mounting hardware for the second retail device.

20. The wedge apparatus of claim 1, wherein:

the body has a width sufficient to accommodate at least one additional mountable retail device;

the graphic panel includes at least one additional hole pattern that does not overlap the hole pattern corresponding to the one of the plurality of hole patterns on the faceplate; and the at least one additional hole pattern corresponds to a mounting-hardware configuration of the at least one additional mountable retail device.

* * * * *